US007641067B2

(12) United States Patent
McCurry

(10) Patent No.: US 7,641,067 B2
(45) Date of Patent: Jan. 5, 2010

(54) TRASHCAN HAVING THE ABILITY TO CONFORM A TRASH BAG

(76) Inventor: Robert T. McCurry, 113 St. Clair Rd., Anderson, SC (US) 29626

( * ) Notice: Subject to any disclaimer, the term of this patent is extended or adjusted under 35 U.S.C. 154(b) by 221 days.

(21) Appl. No.: 11/974,072

(22) Filed: Oct. 11, 2007

(65) Prior Publication Data

US 2009/0095755 A1 Apr. 16, 2009

(51) Int. Cl.
*B65D 25/14* (2006.01)

(52) U.S. Cl. ..... 220/495.04; 220/495.06; 220/908.1

(58) Field of Classification Search ..... 220/676, 220/495.04, 495.06, 908.1
See application file for complete search history.

(56) References Cited

U.S. PATENT DOCUMENTS

| | | | | |
|---|---|---|---|---|
| 2,678,764 | A | 5/1954 | Carlson | |
| 3,463,059 | A | 8/1969 | Vonk | |
| 5,375,732 | A * | 12/1994 | Bowers et al. | 220/676 |
| 5,567,377 | A | 10/1996 | Nishigami et al. | |
| 5,794,670 | A | 8/1998 | LaFleur | |
| 6,634,518 | B1 * | 10/2003 | Jones | 220/495.04 |
| 7,159,734 | B1 | 1/2007 | O'Brien | |
| 2004/0084456 | A1 * | 5/2004 | Lubrano | 220/495.04 |
| 2004/0206760 | A1 | 10/2004 | Gagnebin | |
| 2004/0238542 | A1 | 12/2004 | Camp, Jr. et al. | |
| 2006/0138148 | A1 * | 6/2006 | Mena | 220/495.04 |
| 2006/0175336 | A1 | 8/2006 | Wang | |

* cited by examiner

*Primary Examiner*—Harry A Grosso
(74) *Attorney, Agent, or Firm*—McNair Law Firm, P.A.; Hunter S. Freeman

(57) ABSTRACT

A trash container that can conform a trash bag to the trash container's interior comprising a container having an interior surface for receiving a trash bag; a suction opening disposed in the container for allowing fluid communication between an interior and an exterior of the container when a suction force is applied to the suction opening; a conduit carried by the container's interior surface in fluid communication with the suction opening; a plurality of air channels extending between an interior air passage and an exterior of the conduit to allow air to flow into the interior air passage of the conduit; whereby, air may be drawn through the plurality of air channels into the interior air passage and evacuated through the suction opening, thereby causing the trash bag to conform to the interior surface when a suction force is applied to the suction opening.

17 Claims, 4 Drawing Sheets

TRASHCAN HAVING THE ABILITY TO CONFORM A TRASH BAG

FIELD OF THE INVENTION

Ordinarily, when a trash bag is placed in the interior of a trashcan, it is difficult to situate the trash bag in a manner that allows the greatest volume of trash to be placed in the trash bag. Often times, air becomes trapped between the interior surface of the trashcan and the trash bag, thus decreasing the available volume of the trash bag. Therefore, the present invention relates to a trashcan that has the ability to remove any excess air located between the interior surface of a trashcan and the trash bag, thus conforming the trash bag to the shape of the trashcan's interior surface.

DESCRIPTION OF RELATED ART

U.S. Patent Publication No. 2006/0175336 discloses a trashcan with the function of sucking a litter bag. This patent publication discloses the use of a trashcan having an outer cylinder which houses an inner cylinder that is intended to receive a trash bag. According to the publication, the inner cylinder includes intake holes disposed in the inner cylinder that provide fluid communication between the interior of the inner cylinder and the space between the inner and outer cylinder of the trashcan. The trashcan further includes an air pump for expelling air from between the inner and outer cylinder, thus causing the litter bag to be sucked by the intake holes and conform to the trash bag to the shape of the trashcan's inner cylinder.

U.S. Patent Publication No. 2004/0206760 discloses a similar trashcan including an outer cylinder that houses an inner cylinder. Like the trashcan described above, the inner cylinder receives a trash bag and includes openings in the inner cylinder to provide fluid communication between the inner cylinder and the space between the outer cylinder and the inner cylinder. Again, this trashcan includes an air pump that evacuates the air from between the inner cylinder and the outer cylinder, thus causing the litter bag to be conformed to the shape of the inner cylinder.

The trashcans disclosed in the above patent publications have several disadvantages that are overcome by the present invention. First, the above trashcans unnecessarily require an inner cylinder which adds increased cost and complexity to the trashcans. Further, the inner cylinder included in the trashcans alleviates the need for a trash bag. Therefore, in attempting to solve the difficulties associated with situating a trash bag, the above referenced trashcan has eliminated the need for a trash bag. Further, the above described trashcans require an air pump to be disposed in the trashcans, again adding to the cost and complexity of the trashcans.

Accordingly, it is an object of the present invention to provide a trash container of simple and inexpensive construction having the capability of conforming a trash bag to the interior of the trash container It is a further objective of the present invention to provide a trash container air extractor for modifying an existing trash container to provide it with the ability of conforming a trash bag to the interior of a trash container.

SUMMARY OF THE INVENTION

The above objectives are accomplished according to the present invention by providing a trash container having the capability of conforming a trash bag to the interior surface of the trash container comprising a container having an interior surface for receiving a trash bag; a suction opening disposed in the container for allowing fluid communication between an interior and an exterior of the container so that when a suction force is applied to the suction opening air may freely flow between the interior and the exterior of the container; a conduit carried by the interior surface of the container in fluid communication with the suction opening; an air channel extending between an interior air passage and an exterior of the conduit to allow air to flow into the interior air passage of the conduit; whereby, air may be drawn through the air channel into the interior air passage of the conduit and evacuated through the suction opening, thus evacuating air between the trash bag and the interior surface of the container when a suction force is applied to the suction opening, thereby causing the trash bag to conform to the shape of the interior of the trash container.

In a further embodiment, the trash container includes an evacuation opening operably disposed in the conduit for providing fluid communication between the interior air passage of the conduit and the suction opening.

In a further embodiment, the trash container includes a front surface of the conduit; a rear surface of the conduit; and a first and a second side surface interconnecting the front and rear surfaces. In this embodiment, the air channel is disposed along at least one of the rear surface and the first and second side surfaces. In this embodiment, the evacuation opening is disposed in the rear surface of the conduit.

In a further embodiment, the air channel is disposed generally adjacent to the interior surface of the trash container.

In a further embodiment, air channel extends from the interior air passage of the conduit and through the rear surface and one of the first and second side surfaces of the conduit thus preventing the trash bag from inhibiting the flow of air into the interior air passage of the conduit.

In a further embodiment, the trash container includes an attachment member carried by one of the interior surface of the container and the conduit for securing the conduit to the interior surface of the trash container.

In a further embodiment, the trash container having the capability of conforming a trash bag to the interior of the trash container comprises: a container having an interior for receiving a trash bag; a conduit disposed in the interior of the container; an interior air passage defined by the conduit; an air channel extending between the interior air passage and the exterior of the conduit to allow air to flow into the interior air passage; an evacuation opening disposed in the conduit for providing fluid communication between the interior air passage and the exterior of the conduit; whereby, air may be drawn through the air channel and evacuated from the space between the trash bag and the interior of the container when a suction force is applied to the opening, thereby causing the trash bag to conform to the shape of the interior of the container.

The above objectives are also accomplished according to the present invention by further providing a trash container air extractor for conforming a trash bag to the interior of a trash container comprising: an elongated conduit for placement between an interior surface of the trash container and the trash bag; an air channel extending between an interior air passage of the conduit and an exterior of the conduit to allow air to flow into the interior of the conduit, wherein the air channel is disposed generally adjacent to an interior surface of the trash container; an evacuation opening disposed in the conduit for drawing air through the air channel into the interior air passage of the conduit and out of the evacuation opening; whereby, the conduit is placed between the interior surface of the trash container and the trash bag that is placed in the trash container so that air may be drawn through the air channel and evacuated from between the trash bag and the interior surface of the trash container thereby causing the trash bag to conform to the shape of the interior surface of the trash container when a suction force is applied to the evacuation opening.

In a further embodiment, the trash container air extractor includes a front surface of the conduit; a rear surface of the conduit for placement generally adjacent to the interior surface of the trash container; and a first and a second side surface interconnecting the front and rear surfaces. In this embodiment, the evacuation opening is disposed in the rear surface of the conduit and the air channel is disposed along at least one of the rear surface and the first and second side surfaces of the conduit.

In a further embodiment, the air channel extends from the interior air passage of the conduit and through the rear surface and one of the first and second side surfaces of the conduit, thus preventing the trash bag from inhibiting the flow of air into the interior of the conduit.

In a further embodiment, the trash container air extractor includes an attachment member disposed on the conduit for securing the conduit to the interior of the trash container.

In a further embodiment, the evacuation opening is disposed generally adjacent a proximal end of the conduit.

BRIEF DESCRIPTION OF THE DRAWINGS

The construction designed to carry out the invention will hereinafter be described, together with other features thereof. The invention will be more readily understood from a reading of the following specification and by reference to the accompanying drawings forming a part thereof, wherein an example of the invention is shown and wherein.

DETAILED DESCRIPTION OF A PREFERRED EMBODIMENT

With reference to the drawings, the invention will now be described in more detail.

Figure 1A:
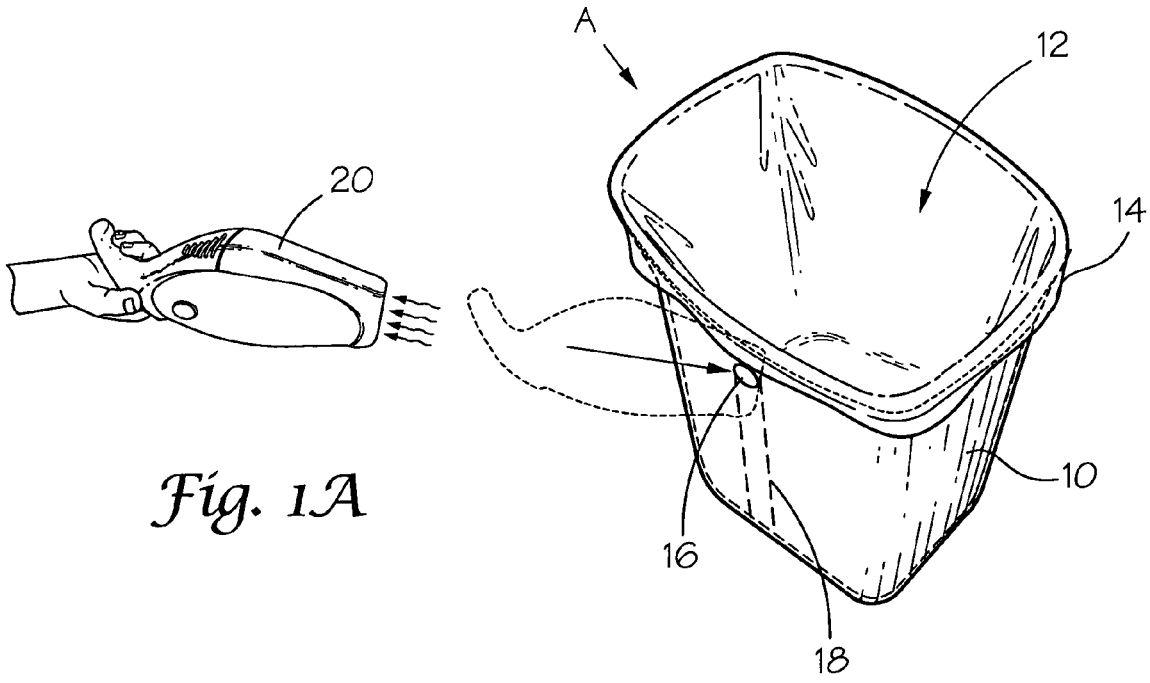
FIG. 1A shows a perspective view of the trash container according to the present invention.

Referring now to FIG. 1A, a first embodiment of a trashcan having the ability to conform a trash bag to the shape of the interior surface of the trashcan is generally shown as A. The trashcan includes a trash container 10 having an interior 12 for receiving a trash bag 14. The trash container 10 includes a suction opening 16 that provides fluid communication between the exterior of the container 10 and the interior of the trash container 12.

As shown by the dotted lines, the trash container 10 further includes a trash container air extractor 18 that is in fluid communication with the suction opening 16. When a suction device 20 is operatively associated with the suction opening 16, air is extracted from the space between the interior of the trash container 12 and the trash bag 14, thus causing the trash bag to conform to the interior of the trash container 12. It should be noted that any device capable of creating a suction force may be used to extract the air from between the trash bag 14 and the trash container's interior.

Figure 1B:
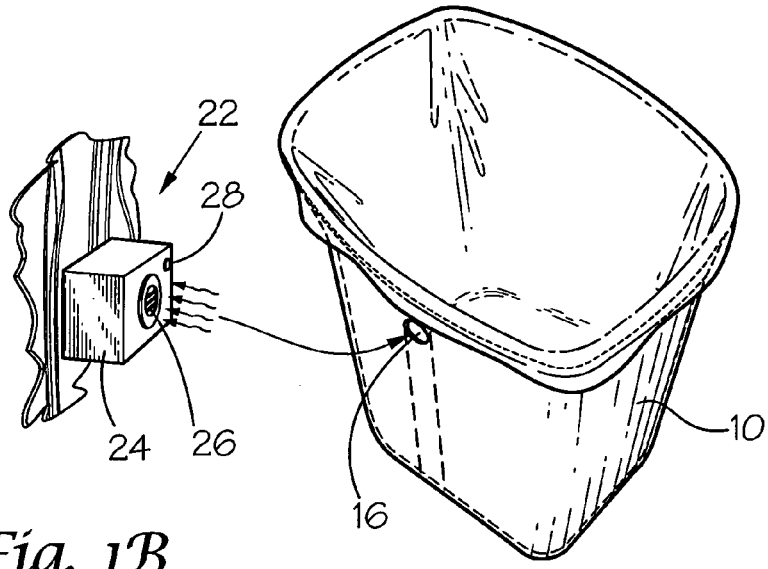
FIG. 1B shows a perspective view of the trash container according to an alternate embodiment of the present invention.

Referring now to FIG. 1B, an alternate suction device 22 is shown. The suction device 22 includes an outer housing 24 that encloses an air pump (not shown). The suction device further includes a suction port 26 that is adapted to be operatively associated with the suction opening 16 defined in the trash container 10. The suction device further includes a pressure switch 28 which activates the enclosed air pump (not shown) when the trashcan 10 is pressed against the suction device, thus depressing the pressure switch 28. Once the trashcan is removed from the suction device 22, the pressure switch 28 returns to a non-depressed state and the air pump (not shown) is deactivated.

Figure 2A:
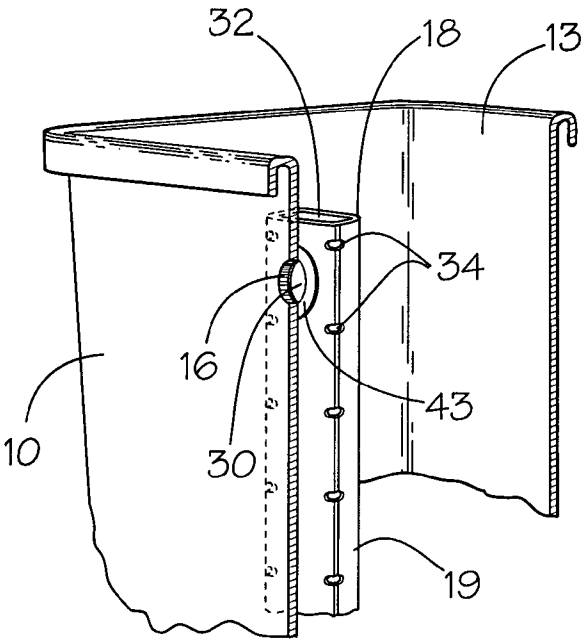
FIG. 2A shows a perspective cutaway view of the trash container showing the trash container air extractor according to the present invention.
Figure 2:
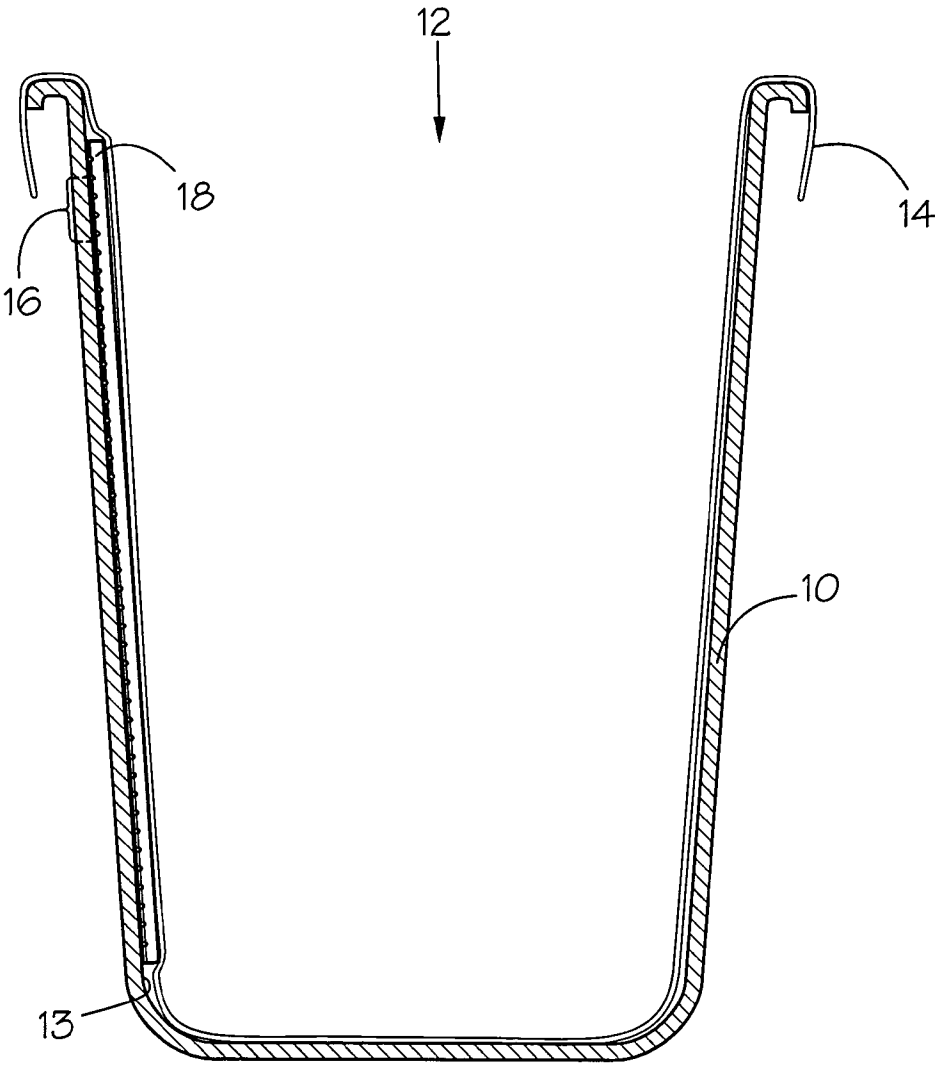
FIG. 2 shows a cross-section of a side elevation view of the trash container showing the trash container air extractor according to the present invention.

Referring now to FIGS. 2 and 2A, the relationship between the trash container air extractor 18 and the trash container 10 can be more clearly seen. The trash container air extractor 18 is carried by an interior surface 13 of the trash container 10 so that when a trash bag 14 is situated in the interior of the trash container 12, the trash container air extractor 18 is located between the trash bag 14 and the interior surface 13 of the trashcan. As can be more clearly seen in FIG. 2A, the trash container air extractor includes a conduit 19 having an evacuation opening 30 that provides fluid communication between the suction opening 16 and the interior air passage 32 defined by the conduit 19. The trash container air extractor 18 further includes an air channel 34 that allows air to be extracted from the space between the interior of the trash container 12 and the trash bag 14 and into the interior air passage 32 of the conduit 19 so that the air may be evacuated from the evacuation opening 30 and out of the suction opening 16. As used herein, the term "air channel" can include one air channel or more than one air channel, as is depicted in the figures.

In one embodiment, a plurality of air channels 34 are disposed along the entire length of the conduit 19. However, it should be understood by one skilled in the art that the conduit 19 can include any number of air channels 34, which can be spaced in any relation to one another. The number and spacing of air channels 34 is immaterial so long as the air channel or plurality of air channels provide the ability for air to be drawn into the conduit's interior air passage 32.

In at least one embodiment, the trash container air extractor 18 is secured to the interior surface 13 of the trash container by an attachment member 43. In at least one embodiment, the attachment member 43 is an adhesive strip. However, one skilled in the art will appreciate that any means of securing the trash container air extractor 18 to the interior surface 13 of the trash container 10 may be used such as glue, tape, screws, bolts, and/or fasteners. This attachment member can be included on the conduit 19, the interior surface 13 of the trash container 10 or both. Alternatively, the trash container air extractor 18 may be molded to or otherwise integral with the interior surface 13 of the trash container.

Figure 3:
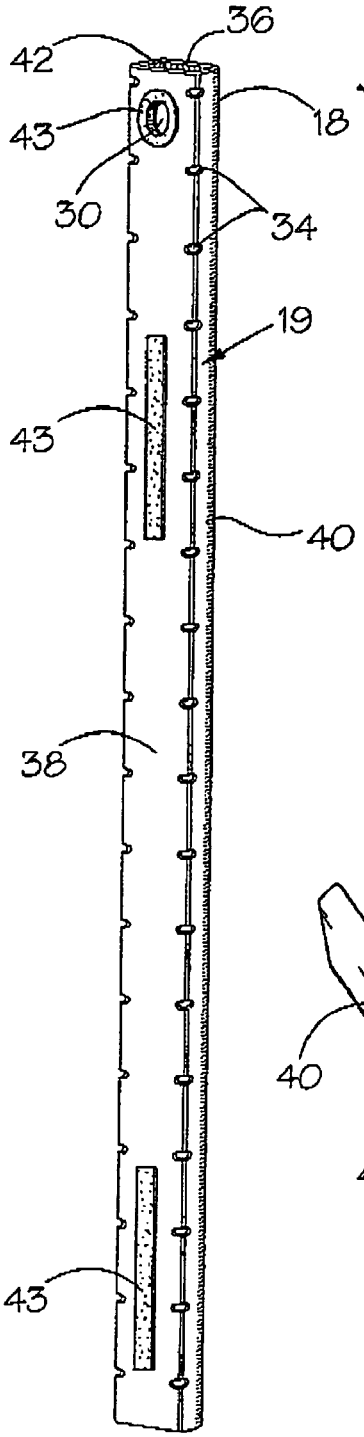
FIG. 3 shows a perspective view of the trash container air extractor according to the present invention.
Figure 4:
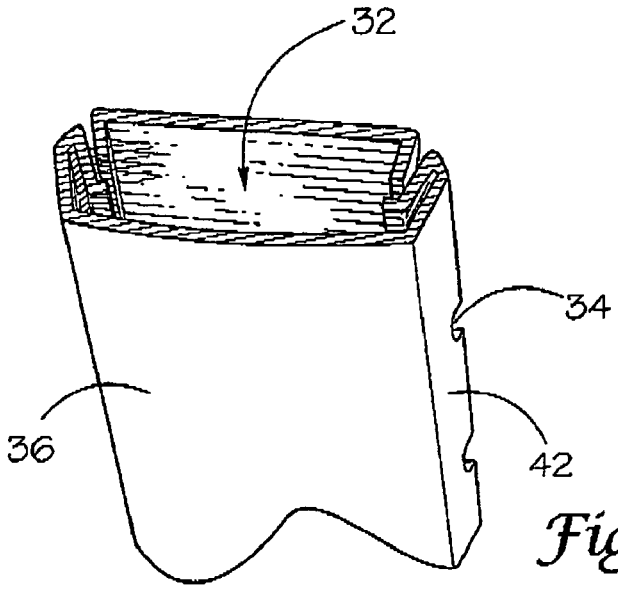
FIG. 4 shows a front perspective view of a distal end of the trash container air extractor according to the present invention.
Figure 5:
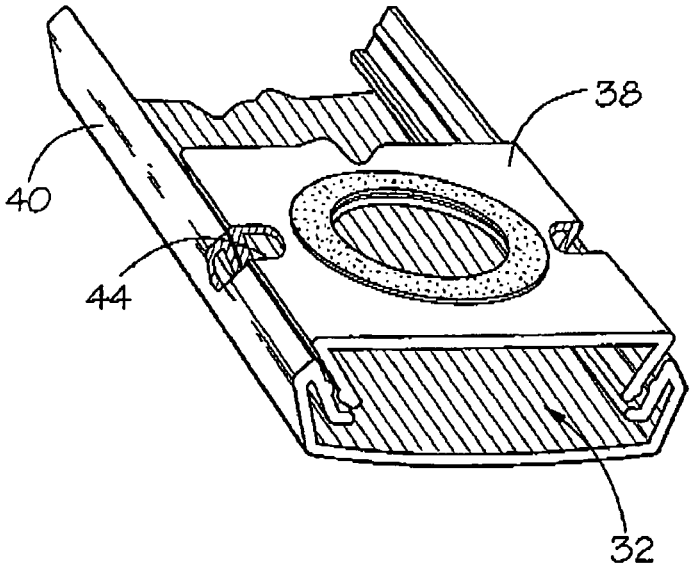
FIG. 5 shows a rear perspective view of a distal end of the trash container air extractor according to the present invention.

Referring now to FIGS. 3, 4 and 5, the trash container air extractor 18 can be more clearly seen. While the conduit 19 can be any shape, including circular, rectangular, square, triangular, semicircle or any other polygonal shape, in one embodiment, the conduit 19 has a front surface 36, a rear surface 38, a first side surface 40 and a second side surface 42. As can be seen in FIGS. 4 and 5, the conduit may be formed from two pieces or a single piece. However, the manner of the conduit's construction, including the shape of the conduit 19 is of little importance so long as the conduit 19 provides the functionality discussed herein.

In one embodiment, a plurality of attachment members 43 are generally spaced along the length of the conduit 19. However, the number and spacing of the attachment members is immaterial so long as the attachment member has the capability of securing the trash container air extractor 18 to the trash container's interior surface 13.

In one embodiment, an air channel 34 or plurality thereof may be disposed on any or each of the conduit's front surface 36, rear surface 38, first side surface 40 and/or second side surface 42. However, in at least one embodiment, an air channel 34 or plurality thereof are disposed along rear surface 38 and the side surfaces 40 & 42 of the conduit 19. When arranged in such a manner, each of the air channels 34 are defined by an opening 44 that extends from the conduit's interior air passage 32 through both the rear surface 38 and one of the side surfaces 40 & 42 of the conduit 19. In at least one embodiment, pairs of air channels 34 are evenly spaced, both horizontally and vertically, along the rear surface 38 and side surfaces 40 & 42 of the conduit 19, thus allowing a greater amount of air to be drawn into the interior air passage 32 of the conduit 19.

Figure 6:
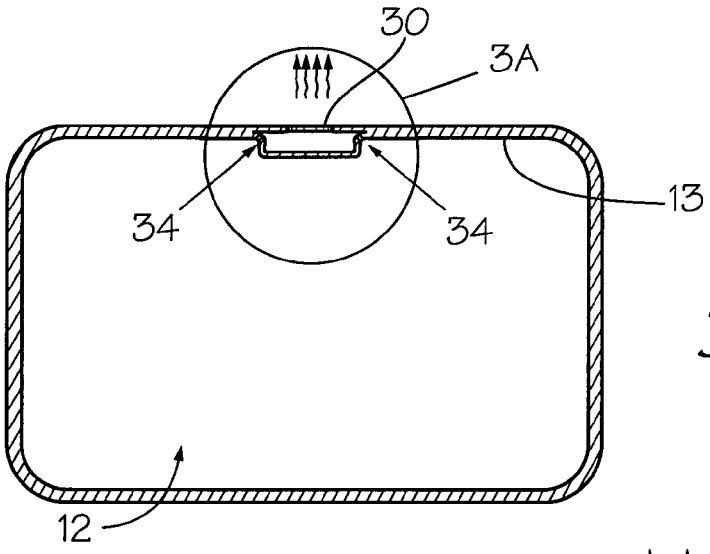
FIG. 6 shows a top cross sectional view showing an alternate embodiment of the present invention.
Figure 6A:
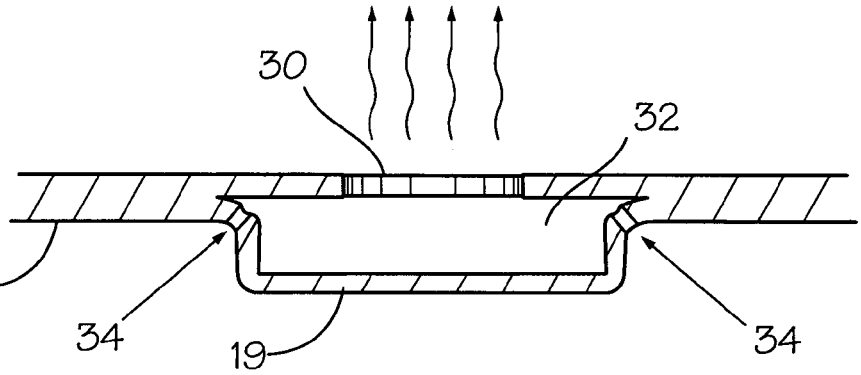
FIG. 6A shows a detailed cross sectional view of the indicated portion of FIG. 3.
Figure 6B:
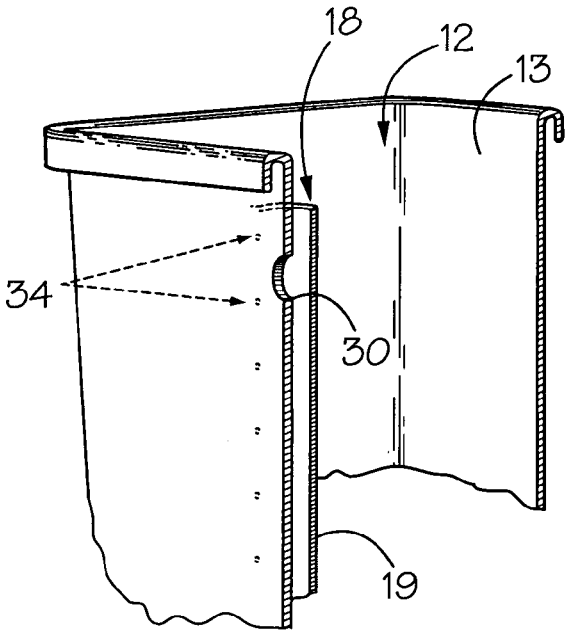
FIG. 6B shows a prospective cutaway of the trash container showing an alternate embodiment of the trashcan air extractor according to the present invention.

Referring now to FIGS. 6, 6A and 6B, an alternate embodiment of the invention is shown. In this embodiment, the trash container air extractor 18 is integrally formed with the trash container's interior surface 13 so that the trash container's interior surface 13 forms the rear surface of the conduit 19. In this embodiment, there is no need for a separate suction opening shown as 16 in FIG. 2A and an evacuation opening shown as 30 in FIG. 2A because the rear surface of the conduit shown as 38 in FIG. 5 is formed by the trash container's interior surface 13. Therefore, in this embodiment, the conduit merely has an evacuation opening 30 which provides fluid communication between the exterior of the trash container 10 and the interior air passage of the conduit 32.

The trash container air extractor 18 further includes an air channel 34 or plurality thereof that are disposed along the length of the conduit 19 for providing fluid communication between the conduit's interior air passage 32 and the trash container's interior 12. As discussed in previous embodiments, the number and spacing of the plurality of air channels 34 is immaterial so long as the air channels provide the ability for air to be drawn into the conduit's interior air passage 32. In one embodiment, these air channels 34 are disposed adjacent to the trash container's interior surface 13 so as to prevent the trash bag 14 from clogging the air channels 34 when a suction force is applied to the evacuation opening 30. However, in alternate embodiments the air channels may be disposed on any or each of the conduit's front and rear surfaces. Further, the air channels 34 could be defined by a distal end of the conduit. In any embodiment, so long as the air channels have the ability to draw air into the conduit's interior passage 32, the placement, number, size or spacing of the air channels is immaterial.

In another embodiment, the conduit 19, whether integrally formed by the trash container's interior surface 13 or secured to the interior surface 13 by an attachment member 43, may extend above the trash container's rim. In this embodiment, the evacuation opening 30 may be formed by a distal end of the conduit 19 or defined in the conduit's rear surface 38, front surface 36, first side surface 40 or second side surface 42, thereby eliminating the need for an opening in the trash container 10 such as a suction opening 16 or an evacuation opening 30.

While a preferred embodiment of the invention has been described using specific terms, such description is for illustrative purposes only, and it is to be understood that changes and variations may be made without departing from the spirit or scope of the following claims.

What is claimed:

1. A trash container having the capability of conforming a trash bag to the interior surface of the trash container comprising:

a container having a top opening defined by at least one side wall and an interior surface defined by a base and said at least one side wall for receiving a trash bag;

a suction opening disposed below said top opening in said at least one side wall and providing fluid communication between an interior and an exterior of said container so that when a suction force is applied to said suction opening air may freely flow from said interior to said exterior of said container;

a conduit carried by said interior surface of said container having an interior air passage defined by a front surface interconnected to a rear surface by a first and second side surface;

an evacuation opening disposed in said rear surface of said conduit and in fluid communication with said suction opening and said interior passage;

an air channel disposed in at least a portion of both of said rear surface and said first side surface of said conduit and in fluid communication with said interior air passage and the interior of said container allowing air to flow from the interior of the container into said interior air passage of said conduit, without obstruction to the flow of air into said interior air passage by the trash bag; whereby, air may be drawn through said air channel and into said interior air passage of said conduit and upwards to said evacuation opening where the air may be evacuated through said suction opening, thus evacuating the air between the trash bag and said interior surface of said container when a suction force is applied to said suction opening, thereby causing the trash bag to conform to the shape of said interior surface of said container.

2. The trash container of claim 1 further comprising an attachment member carried by one of said interior surface of said container and said conduit for securing said conduit to said interior surface of said trash container.

3. The trash container of claim 1, wherein said air channel is disposed generally adjacent to said interior surface of said trash container.

4. The trash container of claim 1, wherein said interior air passage is further defined by a top surface interconnecting said first and second side surfaces said conduit.

5. The trash container of claim 4, wherein said first and second side surfaces of said conduit are interconnected by said base of said container.

6. The trash container of claim 1, wherein said first and second side surfaces of said conduit are interconnected by said base of said container.

7. A trash container air extractor for conforming a trash bag to the interior of a trash container comprising:

an elongated conduit having an interior air passage defined by a front surface interconnected to a rear surface by a first and second side surface for placement between an interior surface of the trash container and the trash bag;

an air channel disposed in at least a portion of both of said rear surface and said first side surface of said conduit and in fluid communication with said interior air passage and the interior of said container allowing air to flow from the interior of the container into said interior air passage of said conduit without obstruction to the flow of air into said interior air passage by the trash bag;

an evacuation opening disposed in said conduit and in fluid communication with said interior air passage and said air channel for drawing air through said air channel into said interior air passage of said conduit and out of said evacuation opening; whereby, said conduit is placed between the interior surface of the trash container and the trash bag that is placed in the trash container so that air may be drawn into said interior air passage through said air channel and upwards to said evacuation opening where the air may be evacuated from between the trash bag and the interior surface of the trash container, thereby causing the trash bag to conform to the shape of the interior surface of the trash container when a suction force is applied to said evacuation opening.

8. The trash container air extractor of claim 7, wherein said evacuation opening is disposed in said rear surface of said conduit.

9. The trash container air extractor from claim 7 further comprising an attachment member disposed on said conduit for securing said conduit to the interior of the trash container.

10. The trash container air extractor from claim 7, wherein said evacuation opening is disposed generally adjacent a proximal end of said conduit.

11. The trash container air extractor of claim 7, wherein said interior air passage is further defined by a top surface interconnecting said first and second side surfaces of said conduit.

12. The trash container air extractor of claim 7, wherein said interior air passage is further defined by a bottom surface interconnecting said first and second side surfaces of said conduit.

13. The trash container air extractor of claim 7, wherein said interior air passage is further defined by a top surface interconnecting said first and second side surfaces of said conduit and a bottom surface interconnecting said first and second side surfaces of said conduit.

14. A trash container having the capability of conforming a trash bag to the interior of the trash container comprising:

a container having an opening defined by at least one side wall and an interior surface defined by a base and said at least one side wall for receiving a trash bag;

a conduit carried by said interior surface of said container;

an interior air passage defined by a front surface of said conduit and a first and a second side surface interconnecting said front surface of said conduit to said at least one side wall of said container;

a radiused surfaced defined by the intersection of said at least one side wall with one of said first and said second side surfaces of said conduit;

an air channel disposed in said radiused surface and in fluid communication with said interior air passage and an interior of said container to allow air to flow into said interior air passage, without obstruction to the flow of air by the trash bag;

a suction opening disposed in said at least one side wall in fluid communication with said interior air passage and the interior of said container; whereby, air may be drawn through said air channel and evacuated from the space between the trash bag and the interior of said container when a suction force is applied to said suction opening, thereby causing the trash bag to conform to the shape of said interior surface of said container.

15. The trash container of claim 14, wherein said interior air passage is further defined by a top surface interconnecting said first and second side surfaces of said conduit.

16. The trash container of claim 14, wherein said first and second side surfaces of said conduit are interconnected by said base of said container.

17. The trash container of claim 14, wherein said interior air passage is further defined by a top surface interconnecting said first and second side surfaces of said conduit and said base of said container.

* * * * *